US005619778A

United States Patent [19]

Sloot

[11] Patent Number: 5,619,778

[45] Date of Patent: Apr. 15, 1997

[54] REFLECTIVE SHOE LACES AND METHOD FOR MAKING SAME

[75] Inventor: Alexander Sloot, Sugarloaf, Pa.

[73] Assignee: Printmark Industries, Inc., Hazleton, Pa.

[21] Appl. No.: 432,090

[22] Filed: May 1, 1995

[51] Int. Cl.[6] ..... A44C 11/02

[52] U.S. Cl. ..... 24/715.4; 24/712

[58] Field of Search ..... 24/715.4, 715.5, 24/715.6, 715.7, 712; 40/316; 87/1

[56] References Cited

U.S. PATENT DOCUMENTS

| | | | |
|---|---|---|---|
| 1,512,162 | 10/1924 | Dennis | 24/715.7 X |
| 2,567,233 | 9/1951 | Palmquist et al. . | |
| 2,646,630 | 7/1953 | Miller | 24/715.4 X |
| 3,172,942 | 3/1965 | Berg . | |
| 3,581,353 | 6/1971 | Sonntag | 24/715.4 |
| 3,936,159 | 2/1976 | Pavenick . | |
| 4,102,562 | 7/1978 | Harper et al. . | |
| 4,248,500 | 2/1981 | Pernicano et al. . | |
| 4,336,087 | 6/1982 | Martuch et al. | 40/316 X |
| 4,392,901 | 7/1983 | Pernicano et al. . | |
| 4,401,494 | 8/1983 | Pernicano et al. . | |
| 4,488,642 | 12/1984 | Changani et al. | 40/316 X |
| 4,496,618 | 1/1985 | Pernicano . | |
| 4,651,447 | 3/1987 | Sullivan . | |
| 4,763,985 | 8/1988 | Bingham . | |
| 5,316,838 | 5/1994 | Crandall et al. . | |

FOREIGN PATENT DOCUMENTS

| | | | |
|---|---|---|---|
| 242815 | 11/1925 | United Kingdom | 24/715.4 |

*Primary Examiner*—James R. Brittain

*Attorney, Agent, or Firm*—St. Onge Steward Johnston & Reens LLC

[57] ABSTRACT

A reflective lace, such as a shoelace, used for night visibility, and a method of manufacture, is provided by affixing a flexible reflective attachment near the end portion thereof. Preferably, the reflective attachment comprises a thermoplastic tube with a reflective outer coating which is drawn over the end portion of the lace and heat-fused to the outside surface of the lace near the end portion. The article and method of manufacture provides a reflective lace which includes the desirable characteristics of a standard lace and which eliminates unused reflective material present in past designs.

12 Claims, 3 Drawing Sheets

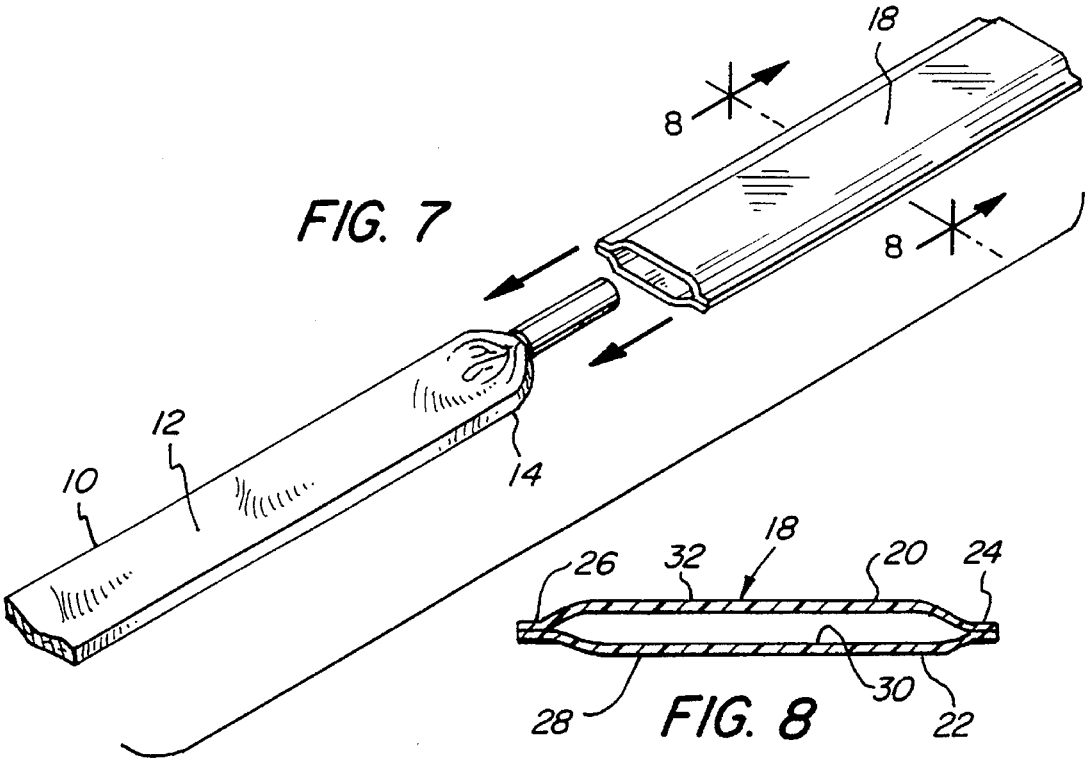
FIG. 7
FIG. 8
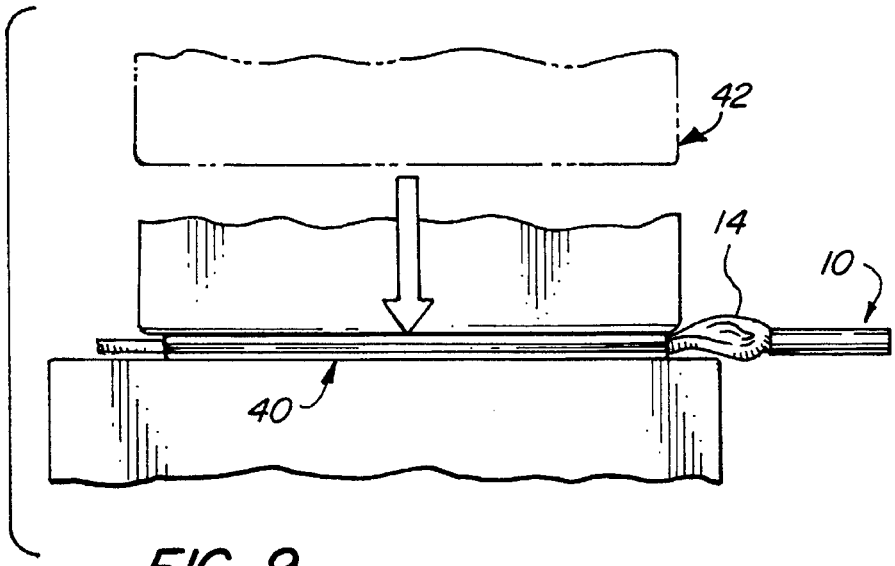
FIG. 9

REFLECTIVE SHOE LACES AND METHOD FOR MAKING SAME

FIELD OF THE INVENTION

The invention relates to reflective clothing and more particularly to reflective laces and drawstrings for the safety of runners and walkers and a method for making them.

BACKGROUND OF THE INVENTION

Walking and running are widely recognized as healthful methods of exercise. Walkers and runners often use roads as the paths for such exercise because these provide the only or best available areas to do so. Also, while many people enjoy these forms of exercise, many people may only do so at night because of daytime commitments such as work or child-care.

It is clear that, at night, it can be hazardous for runners and walkers to share a road with automobile traffic. In an attempt to decrease that risk, various attempts have been made to increase the visibility of such persons. One method known is the use of clothing or accessories which are brightly colored, such as day-glow vests. While this method is helpful, it has been found that the most effective way to increase the visibility of a pedestrian at night is the use of reflective materials. Reflective materials are more desirable because they reflect nearly all of the light incident upon them thereby creating a glowing appearance at night.

One example of the use of reflective materials is the inclusion of reflective materials on a vest. Another example is the inclusion of reflective materials in the shoelaces worn by the person exercising. In one prior art method, a reflective shoelace is made by weaving reflective thread into a standard shoelace. While this method is effective, the process of weaving such thread into a standard shoelace is expensive. Also, much of the reflective material added to the shoelace is unused and wasted because it is not on the outside of the lace. Moreover, of the reflective material that is one the outside of the lace, much is hidden by the shoe or by other sections of the lace itself, and thereby rendered ineffectual. Furthermore, the reflective material must be added during the initial manufacturing process, and cannot be added at any later time.

In another prior art method, a reflective shoelace is created by folding a long piece of reflective fabric in half around an adhesive, and then adding small non-reflective tubes on the ends to aid in threading the material into a shoe. (An example of this type of shoelace is disclosed by U.S. Pat. No. 4,651,447 to Sullivan.) This prior art lace design is also intended to enhance visibility, however, nearly the entire structure is made of relatively high-cost reflective material, and as with the prior art design mentioned above, much of that reflective material is hidden and unused. Moreover, because the prior art reflective shoelace is composed of reflective material (which is necessarily a plastic-like material), it does not have some of the desirable qualities of other types of shoelaces such as woven cotton laces. Some of these desired qualities include a greater thickness and resilient compressibility (which aid in untying knots), slip-resistance (which helps prevent jammed knots and also helps prevent the lace from shifting when tied), better gripping when wet, and a more desirable texture.

SUMMARY OF THE INVENTION

The reflective lace of the present invention, which overcomes the drawbacks of the prior designs, is suitable for use as a shoelace or as a lace for another type of garment, or as drawstring. Therefore, for the purposes of this application, the term lace shall include shoelaces, laces for other types of garments (such as jackets and sweatpants), and drawstrings.

With a reflective lace in accordance with the invention, enhanced reflectivity is obtained while the lace is also more likely to be observed by a driver from a retro-reflection of the car's head lights. This is achieved in accordance with one form of the invention by providing end portions of a lace with fully reflecting surfaces. In one form of the invention end portions of a lace are covered by reflective materials which are affixed to a lace fabric. The reflective material provides a reflecting surface instead of a reflective thread and covers but a portion of the lace and preferably near its ends so as to provide a relatively inexpensive yet effective reflecting lace.

In a preferred form of a reflective lace in accordance with the invention the lace has tubes made of heat-fusible reflective films which are affixed to ends of the lace. The tubes are conveniently affixed to the lace's fabric by fusing the retro-reflective tubes to the lace.

Accordingly, it is an object of the invention to provide a retro-reflective lace whose reflectivity is enhanced and is inexpensive to manufacture.

Another object of the present invention is to provide a lace formed of conventional fabric material and which has an enhanced reflective characteristic at its ends.

Still another object of the present invention is to provide a method for the manufacture of a reflective lace of the above characteristics.

Further still it is an object of the present invention to provide a method having the above characteristics whereby the reflective portions of the lace may be added after the lace is initially manufactured.

It is, therefore, a further object of the invention to provide a reflective lace to be worn by persons who exercise at night in which reflective material can be applied to the outside of a standard, woven lace, on the portions of the lace which are always visible and after the lace is initially manufactured.

The invention and its particular features and advantages will become more apparent from the following detailed description considered with reference to the accompanying drawings.

BRIEF DESCRIPTION OF THE DRAWINGS

FIG. 7 is an exploded, perspective view of the lace of FIG. 2 showing the method by which the reflective tube is drawn over the end of the lace.

FIG. 8 is a cross-sectional view of the reflective tube of FIG. 7 as seen along line 8—8 in FIG. 7.

FIG. 9 is a side view of the lace of FIG. 2 showing the method by which a reflective tube is affixed to the lace.

DETAILED DESCRIPTION OF THE INVENTION

Figure 1:
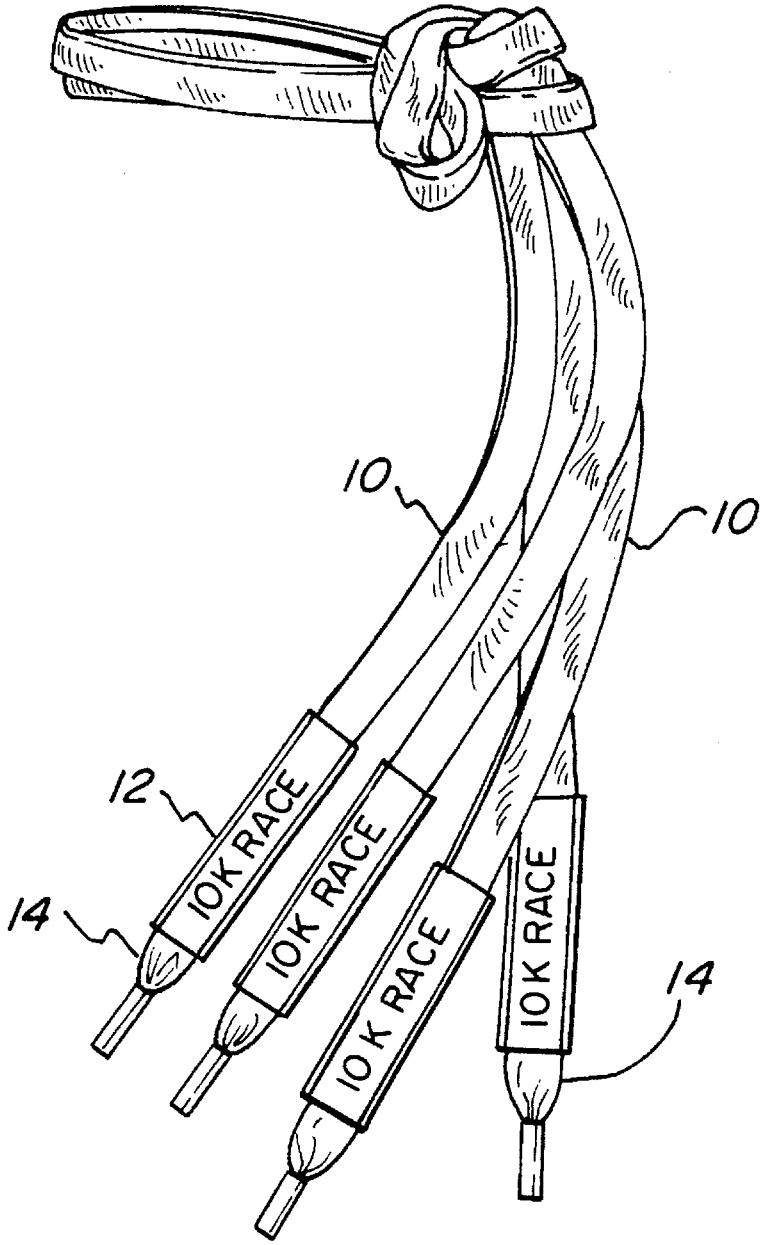
FIG. 1 is a perspective view of a pair of retro-reflective laces made in accordance with the present invention.

Referring to FIG. 1, two reflective laces 10 of the present invention have reflective attachments 12 which are affixed near the end portions 14 of the laces 10.

Figure 2:
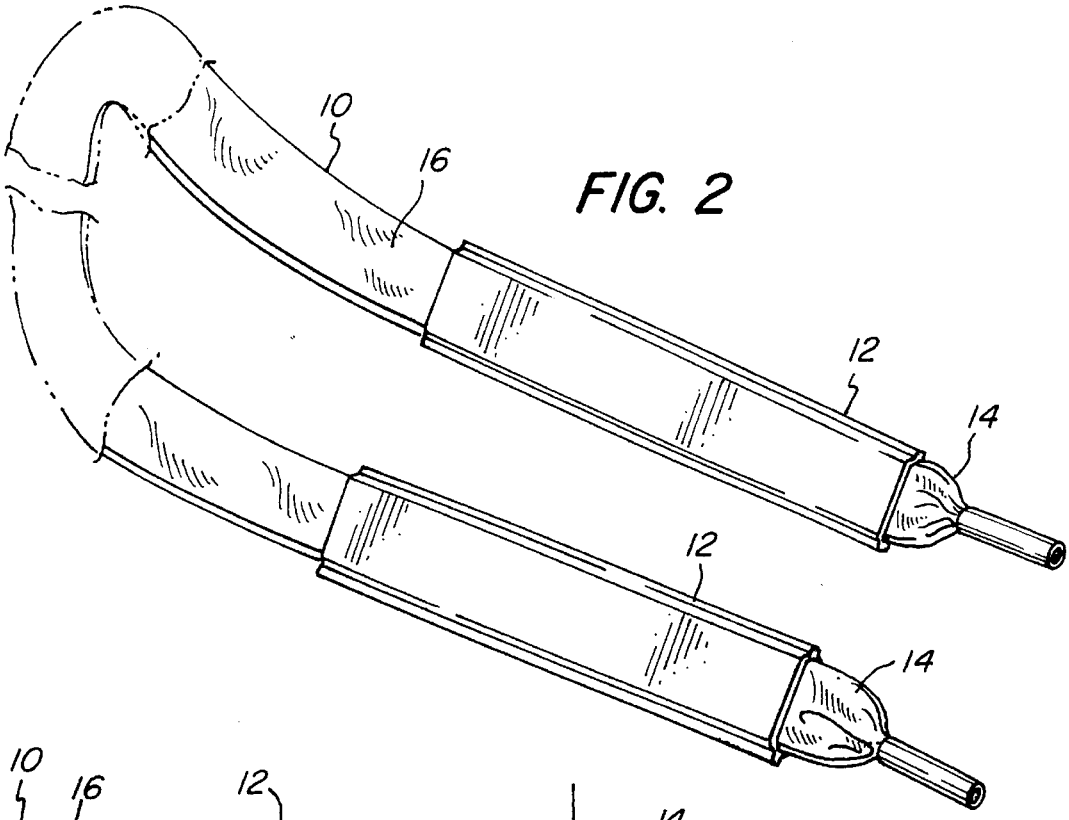
FIG. 2 is a perspective view of one reflective lace as shown in FIG. 1 showing the reflective tubes affixed to the lace.
Figure 3:
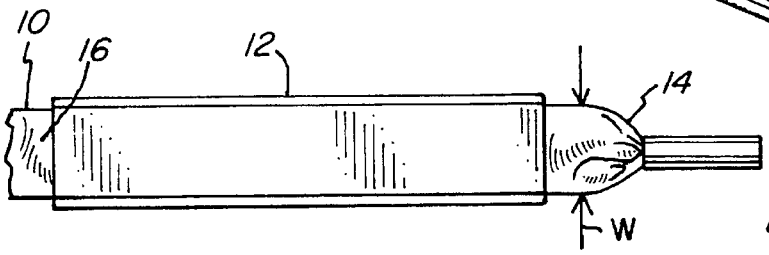
FIG. 3 is a top view of one end of the lace shown in FIG. 2 showing a reflective tube affixed near the end of the lace.
Figure 4:
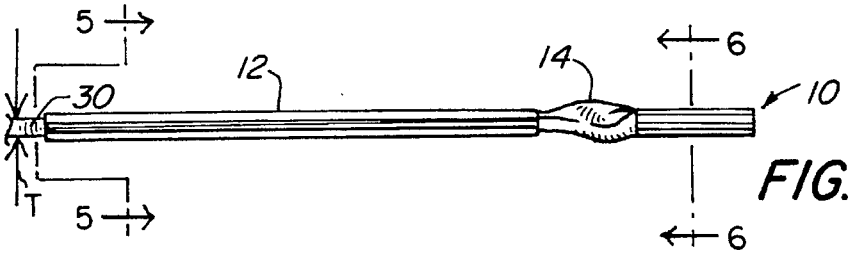
FIG. 4 is a side view of the shoelace end shown in FIG. 3.

Referring to FIG. 2, 3 and 4, the lace 10 of the present invention has an outside surface 16 to which a reflective attachment 12 is affixed. The reflective attachment 12 is affixed to the outside surface 16 of the lace 10 near the end portion 14 thereof. The reflective attachment 12 may be comprised of a single piece or may be comprised of multiple, independent pieces, but, preferably, it is comprised of a pre-formed tube which is drawn over the end portion 14 of the lace, as will be discussed below. The reflective attachment 12 may be affixed to the lace 10 by any appropriate method, such as by gluing or stitching, however, preferably the reflective attachment 12 is fused to the lace 10. This process will also be discussed below.

Figure 5:
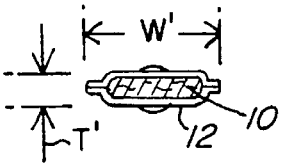
FIG. 5 is a cross-sectional view of the lace of FIG. 4 as seen along line 5—5 in FIG. 4.

Standard woven laces (which, as defined above, include shoelaces and drawstrings) typically are tubular in shape and, when initially manufactured, are flat as shown in FIG. 3 and 4. In this state they have a width, shown as W in FIG. 3 and a thickness, shown as T in FIG. 4. As shown by the cross-section, this width and thickness creates a profile of the lace. When affixed, the inside surface 30 of the reflective attachment 12 conforms to this profile, and, preferably the reflective attachment 12 does not substantially increase the width or thickness of the lace. As shown in FIG. 5, the reflective attachment conforms to the profile of the lace 10, and the width and thickness of the lace 10 with the reflective attachment 12 (W' and T' respectively) is substantially the same as without (W and T). It should be noted however that this is not a necessary limitation to the present invention. That is, it would still be within the scope of the invention if the reflective attachment 12 were to increase the width and/or thickness of the lace in one or more portions more than unsubstantially.

It should also be appreciated that while many types of laces are tubular, the lace of the present invention may be of any configuration, such a cylindrical, and still be within the contemplation present invention.

Figure 6:
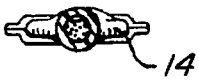
FIG. 6 is a cross-sectional view of the shoelace of FIG. 4 as seen along line 6—6 in FIG. 4.

Referring to FIG. 5 and 6, preferably, the reflective attachment 12 surrounds the lace 10, and, over the length of the reflective attachment 12, completely covers the lace 10. It should be appreciated, however, that the reflective attachment 12 may contain holes through which the outside surface 16 of the lace 10 is visible and need not completely surround the lace 10.

Referring to FIG. 7, preferably, the reflective attachment 12 is comprised of a pre-formed reflective tube 18. The reflective tube 18 is drawn over the end portion 14 of the lace 10 as shown. Optimally, the tube is between ½" and 3" long, but it may be of any desired length.

Referring to FIG. 8, preferably, the reflective tube 18 is comprised of first and second layers of reflective material 20, 22 which are sealed together creating first and second seals 24, 26 thereby creating the reflective tube 18. These seals may be created with heat sealing, R.F. sealing or a similar method.

It should be appreciated however, that the reflective tube 18 may be composed of a single piece of reflective material which is folded in half and sealed along one line, or it may be composed of a unitary piece, such as an injection molded tube, or it may be comprised of a similar structure.

Also, it should be appreciated that it would still be within the scope of the present invention if, instead of a tube, the reflective attachment 12 were to take the form of one or more sections of reflective material (not shown anywhere) which are independently affixed to the outside surface 16 of the lace 10. Thus, all of the details disclosed herein regarding the reflective tube 18 apply equally to any such independent sections of reflective material.

The reflective tube 18 has an outer surface 28 and an inner surface 30. Preferably, the outer surface 28 of the reflective tube 18 has a reflective coating 32, and a protective coating (not shown anywhere) may cover that reflective coating 32.

The layer or layers which form the reflective attachment maybe cut from a single sheet of reflective material. Such a single sheet may be printed with an array of designs (such as a company logo) in a single step prior to being cut into a plurality of smaller pieces forming layers for the reflective attachment.

Preferably the material used for the reflective tube 18 is a heat-fusible thermoplastic material which includes a reflective coating 32 on at least one surface. However, the material could also be fabric-backed or pressure-sensitive material. Preferably, the reflective coating 18 is relatively impervious to the heat and pressure, so as to withstand the heat fusing process described more fully below. An example of this type of material is glass-bead, retro-reflective material available from the 3M Corporation.

Referring to FIG. 9, to manufacture the article of the present invention, the lace/reflective-tube assembly 40 is placed in a die 42 whereby the inner surface 30 of the thermoplastic reflective tube 18 is fused to the outside surface 16 of the lace 10 near the end portion 14 thereof. The fusing processes also fuses the inside surface 30 of the reflector tube 18 into the interstices of the lace 10 creating a permanent bond thereto. As mentioned above, other methods of attachment are still within the scope of the invention, however, it has been found that fusing creates the strongest bond between the reflective tube 18 and the lace 10.

The reflective tube 18 may be fused to the lace 10 by various methods. Preferably, this fusing step is accomplished using heat fusing, however other methods, such as pressure fusing or R.F. fusing may be applicable.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A reflective lace comprising:

a lace having an outside surface, having a sealed end portion, and having a profile;

a flexible reflective attachment having an inner surface; said flexible reflective attachment being affixed to said outside surface of said lace adjacent to said sealed end portion; and said inner surface of said reflective attachment substantially conforming to said profile of said lace.

2. A claim as in claim 1 wherein said reflective attachment comprises a tube having an inner surface and having an outer reflective surface; said inner surface of said tube being affixed to said outside surface of said lace at said sealed end portion so that said outer reflective surface of said tube can be visibly detected when said lace is inserted.

3. A claim as in claim 2 wherein said tube comprises a tube of heat-fusible thermoplastic material.

4. A claim as in claim 1 wherein said reflective attachment comprises a strip of reflective material having an inner surface and an outer reflective surface; and said inner surface of said strip being affixed to said outside surface of said lace at said sealed end portion so that said outer reflective surface of said strip can be visibly detected when said lace is inserted.

5. A claim as in claim 4 wherein said strip comprises a strip of heat-fusible thermoplastic material.

6. A method of manufacturing a reflective lace comprising the steps of:

providing a lace having an outside surface, having a sealed end portion, and having a profile;

providing a flexible reflective attachment having an inner surface and having a reflective outer surface;

affixing said reflective attachment to said outside surface of said lace adjacent to said sealed end portion; and substantially conforming said inner surface of said reflective attachment to said profile of said lace.

7. The method as in claim 6 wherein:

said step of providing a flexible reflective attachment having a reflective outer surface comprises forming a tube of thermoplastic material having a reflective outer surface; and said step of affixing said reflective attachment to said outside surface of said lace comprises drawing said tube over said end portion of said lace, and fusing said tube to said outside surface of said lace.

8. The method as in claim 7 wherein said step of fusing said thermoplastic material to said outside surface of said lace comprises providing a heat-fusion die and heat fusing said thermoplastic material to said outside surface of said lace.

9. The method as claimed in claim 7 wherein said step of forming a tube of thermoplastic material having a reflective outside surface comprises providing two layers of thermoplastic material each having a reflective surface; and fusing said layers to one another along two lines.

10. The method as in claim 6 wherein:

said step of providing a flexible reflective attachment having a reflective outer surface comprises providing a strip of thermoplastic material having a reflective outer surface; and said step of affixing said reflective attachment to said outside surface of said lace comprises fusing said strip to said outside surface of said lace.

11. The method as in claim 10 wherein said step of fusing said thermoplastic material to said outside surface of said lace comprises providing a heat-fusion die and heat fusing said thermoplastic material to said outside surface of said lace.

12. The method as in claim 6 wherein said step of providing a flexible reflective attachment further comprises:

providing a sheet of flexible reflective material;

printing a plurality of designs on said sheet; cutting said sheet into a plurality of pieces, each of said pieces bearing one of said designs.

* * * * *